US009203161B2

(12) United States Patent
Orihashi et al.

(10) Patent No.: US 9,203,161 B2
(45) Date of Patent: Dec. 1, 2015

(54) ANTENNA APPARATUS AND METHOD OF ADJUSTING THE SAME

(75) Inventors: Naoyuki Orihashi, Tokyo (JP); Kenichi Maruhashi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 374 days.

(21) Appl. No.: 13/698,211

(22) PCT Filed: Apr. 15, 2011

(86) PCT No.: PCT/JP2011/002236

§ 371 (c)(1),
(2), (4) Date: Nov. 15, 2012

(87) PCT Pub. No.: WO2011/145268

PCT Pub. Date: Nov. 24, 2011

(65) Prior Publication Data

US 2013/0057449 A1 Mar. 7, 2013

(30) Foreign Application Priority Data

May 21, 2010 (JP) ..... 2010-117306

(51) Int. Cl.
*H01Q 21/24* (2006.01)
*H01Q 9/04* (2006.01)

(52) U.S. Cl.
CPC ..... *H01Q 21/24* (2013.01); *H01Q 9/0435* (2013.01)

(58) Field of Classification Search
CPC ..... H01Q 21/24
USPC ..... 343/853
See application file for complete search history.

(56) References Cited

U.S. PATENT DOCUMENTS

2006/0087385 A1* 4/2006 Fitzpatrick et al. ..... 333/117

FOREIGN PATENT DOCUMENTS

| | | | |
|---|---|---|---|
| JP | S59044107 | A | 3/1984 |
| JP | S61112404 | A | 5/1986 |
| JP | H01162913 | U | 11/1989 |
| JP | H03089606 | A | 4/1991 |
| JP | H06077916 | A | 3/1994 |
| JP | 2002043823 | A | 2/2002 |
| JP | 2004242277 | A | 8/2004 |

OTHER PUBLICATIONS

The international search report for PCT/JP2011/002236 mailed on Jul. 19, 2011.
Japanese Office Action for JP Application No. 2012-515719 mailed on Jan. 6, 2015 with English Translation.

* cited by examiner

*Primary Examiner* — Dameon E Levi
*Assistant Examiner* — Andrea Lindgren Baltzell

(57) ABSTRACT

An antenna apparatus 1 includes a high-frequency output portion 2 for outputting a high-frequency signal, an antenna 5 including a first excitation unit 3 and a second excitation unit 4, the first excitation unit 3 emitting a first linearly polarized wave according to the high-frequency signal output from the high-frequency output portion 2, the second excitation unit 4 emitting a second linearly polarized wave that is orthogonal to the first linearly polarized wave at the same time with the first linearly polarized wave according to the high-frequency signal output from the high-frequency output portion, and a phase adjustment portion 6 for adjusting a phase of at least one of the high-frequency signal to be input to the first excitation unit 3 and the high-frequency signal to be input to the second excitation unit 4 in a range of change from 0 to 270 or more degrees.

8 Claims, 7 Drawing Sheets

ANTENNA APPARATUS AND METHOD OF ADJUSTING THE SAME

TECHNICAL FIELD

The present invention relates to an antenna apparatus and a method of adjusting the same that are able to improve communication quality.

BACKGROUND ART

In recent years, there has been a growing need for gigabit-class high-speed radio used in an indoor environment. For example, the use of a high-frequency band (e.g., 60 GHz) has been promoted since it facilitates broadband transmission compared to a microwave band equal to or smaller than about 6 GHz which has been conventionally used. On the other hand, a radio wave in such a high-frequency band has characteristics that it has small diffraction and strong rectilinear propagation properties. Thus, when there is an obstruction between communication apparatuses that transmit and receive radio waves in the high-frequency band, there are caused problems that communication quality is deteriorated, and in particular, communication is interrupted in a millimeter waveband.

In order to solve the problems, for example, such a measure is taken to maintain the communication quality by using a reflected wave instead of using a direct wave when there is an obstruction between the communication apparatuses as described above. Meanwhile, it may be possible that the phase of an input radio wave by the reflected wave is inverted. Thus, the use of a circularly polarized wave in a transmitting antenna and a receiving antenna may dramatically decrease the reception power.

Accordingly, a linearly polarized wave is typically used in the reflected wave communication stated above. In this case, there are two main problems as follows. The first problem is that, when linearly polarized wave antennas are used in a transmitter and a receiver, the reception sensitivity becomes maximum if the polarization directions of the antennas are uniformly oriented, whereas the reception sensitivity may be deteriorated if there are deviations in the polarization directions. Further, when the reflected wave communication is executed in an indoor area (in particular, home environment), if there is a restriction in the positional relation in which the transmitter and the receiver are installed and it is required to keep the angles of the transmitting and receiving antennas constant in order to prevent this problem, it may dramatically impair convenience.

The second problem is that a reflectance of a reflector greatly varies according to the incident angle of the wave and the polarization direction that is used. For example, when a parallel polarized wave is used, it may be possible that the reception sensitivity cannot be obtained at a specific incident angle corresponding to Brewster's angle. This is because the reflectance of the reflector depends on the angle between the electrical field excitation direction of the linearly polarized wave and the reflection surface. In general, the reflection surface in an indoor area includes not only a horizontal or vertical reflection surface such as walls or floors but also an oblique reflection surface such as a sofa arranged indoors. Furthermore, since the environment in which radio waves propagate is easy to change in an indoor area due to the exit and entry of people, for example, it is preferable to secure a plurality of communication paths. In such a case, various reflection surfaces are used for each of the communication paths. Accordingly, in order to solve the two problems, it is required to vary the polarization direction. Further, when the polarized wave of the radio wave emitted from the communication partner is unknown, it is required not only to generate a linearly polarized wave, but also to generate right-hand and left-hand circularly (or elliptically) polarized waves.

A method of changing the polarization direction includes a method of arranging a plurality of excitation units in an antenna, for example. Further, this method of arranging the plurality of excitation units includes a method of adjusting input power and an input phase difference to each excitation unit and a method of switching the excitation units for each desired polarization wave. Among them, the former method is easier in its creation method and usage, and has been widely used.

For example, as shown in FIG. 8, a related antenna apparatus 800 includes a high-frequency source 801, a branch circuit 802, phase shifters 803, power supply lines 804, and a patch antenna 805. A high-frequency signal output from the high-frequency source 801 is divided by the branch circuit 802, and then input to the patch antenna 805 via the phase shifters 803 and the power supply lines 804. Two excitation units on the patch antenna 805 connected to the respective power supply lines 804 excite radiation electric fields that are orthogonal to each other. The phases of the high-frequency signals input to the two excitation units have a phase difference of 0°, 90°, 180°, and 270°, for example, by the phase shifters 803. For example, when the linearly polarized wave is generated, the phase difference of 0 or 180 degrees is provided, and when the circularly polarized wave is generated, the phase difference of 90 or 270 degrees is provided.

Further, an antenna apparatus including an antenna element for emitting two orthogonal linearly polarized waves from two excitation units and a phase shifter for adjusting a phase difference for every 90 degrees is known (e.g., see PTL 1).

CITATION LIST

Patent Literature

PTL 1: Japanese Unexamined Patent Application Publication No. 03-089606

SUMMARY OF INVENTION

Technical Problem

Incidentally, when a millimeter waveband having a small wavelength is used in the related antenna apparatus 800, a manufacturing error of the power supply lines 804 gives great influence on the input phase difference to each excitation unit. For example, when the linearly polarized wave is generated, the input phase difference is set to 0 or 180 degrees. However, when the error is generated from this set value, the axial ratio is degraded and an elliptically polarized wave is generated. Further, when communication is performed in a transmitting antenna and a receiving antenna by setting the polarization directions of the antennas to be uniformly oriented, the degradation of the axial ratio stated above causes degradation in the input sensitivity. Further, interference occurs due to spurious waves having different polarization directions, which may reduce communication quality.

Consider now, for example, the influence on the axial ratio characteristics when a ceramic substrate is used as an antenna substrate and the manufacturing error of the power supply lines is 50 micrometers. The input phase error in the microwave (6 GHz) corresponds to about 0.8 degrees, the axial ratio is ideally 43 dB, and a substantially linearly polarized wave is generated. Meanwhile, the input phase error in 60 GHz corresponds to 8 degrees, and the axial ratio is ideally 23 dB. Further, the influence of the manufacturing error in the antenna element is added, which causes further degradation of the axial ratio.

Accordingly, even when a phase shifter or a path switch unit that provides the phase difference for every 90 degrees is used as in the antenna apparatus shown in PTL 1, it is difficult to correct the phase error caused by the manufacturing error of the power supply lines. In this way, it is desired to provide an antenna apparatus that is not affected by the degradation of the axial ratio due to the manufacturing error of the power supply lines.

The present invention has been made in order to solve the aforementioned problems, and mainly aims to provide an antenna apparatus and a method of adjusting the same that are able to improve communication quality.

Solution to Problem

An exemplary aspect of the present invention to accomplish the exemplary objects above is an antenna apparatus including: high-frequency output means for outputting a high-frequency signal; antenna means including a first excitation unit and a second excitation unit, the first excitation unit emitting a first linearly polarized wave according to the high-frequency signal output from the high-frequency output means, the second excitation unit emitting a second linearly polarized wave that is orthogonal to the first linearly polarized wave at the same time with the first linearly polarized wave according to the high-frequency signal output from the high-frequency output means; and phase adjustment means for adjusting a phase of at least one of the high-frequency signal to be input to the first excitation unit and the high-frequency signal to be input to the second excitation unit in a range of change from 0 to 270 or more degrees.

Another exemplary aspect of the present invention to accomplish the exemplary objects above may be a method of adjusting an antenna apparatus including: high-frequency output means for outputting a high-frequency signal; and antenna means including a first excitation unit and a second excitation unit, the first excitation unit emitting a first linearly polarized wave according to the high-frequency signal output from the high-frequency output means, the second excitation unit emitting a second linearly polarized wave that is orthogonal to the first linearly polarized wave at the same time with the first linearly polarized wave according to the high-frequency signal output from the high-frequency output means, in which a phase of at least one of the high-frequency signal to be input to the first excitation unit and the high-frequency signal to be input to the second excitation unit is adjusted in a range from 0 to about 270 or more degrees.

Advantageous Effects of Invention

According to the present invention, it is possible to provide an antenna apparatus and a method of adjusting the same that are able to improve communication quality.

DESCRIPTION OF EMBODIMENTS

Figure 1:
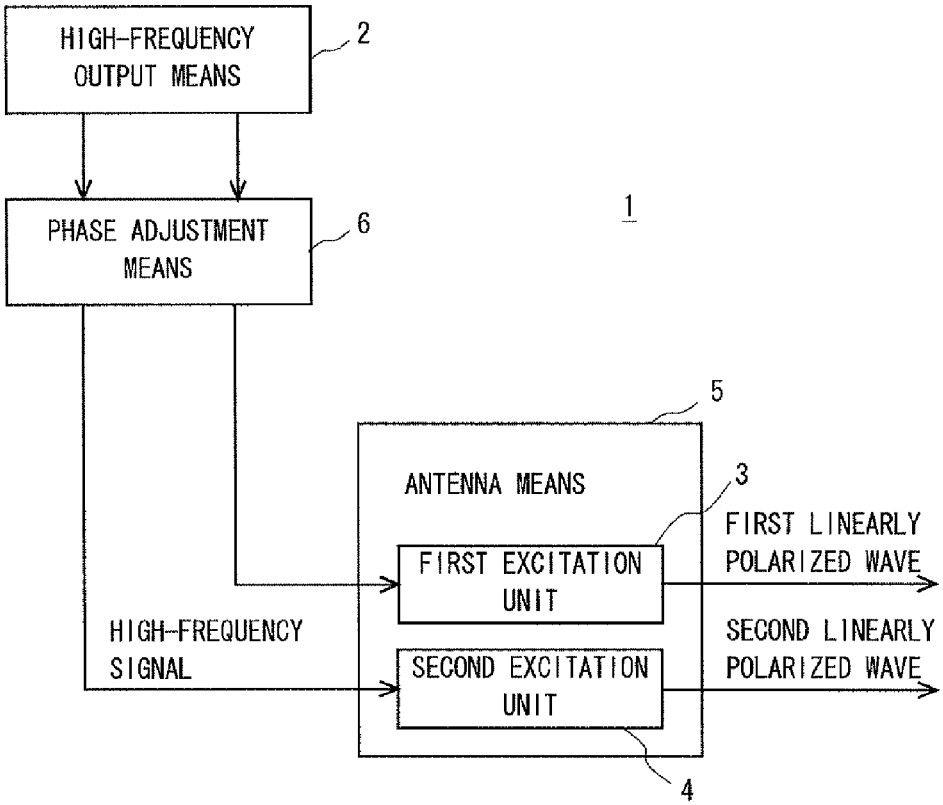
FIG. 1 is a functional block diagram of an antenna apparatus according to an exemplary embodiment of the present invention.

Hereinafter, with reference to the drawings, exemplary embodiments of the present invention will be described. FIG. 1 is a functional block diagram of an antenna apparatus according to an exemplary embodiment of the present invention. An antenna apparatus 1 according to this exemplary embodiment includes a high-frequency output means 2 for outputting a high-frequency signal, an antenna means 5 including a first excitation unit 3 for emitting a first linearly polarized wave and a second excitation unit 4 for emitting a second linearly polarized wave, and a phase adjustment means 6 for adjusting a phase of at least one of the high-frequency signal to be input to the first excitation unit 3 and the high-frequency signal to be input to the second excitation unit 4 in a range of change from 0 to 270 or more degrees.

The first excitation unit 3 emits the first linearly polarized wave according to the high-frequency signal output from the high-frequency output means 2. Further, the second excitation unit 4 emits the second linearly polarized wave that is orthogonal to the first linearly polarized wave at the same time with the first linearly polarized wave according to the high-frequency signal output from the high-frequency output means 2.

The phase adjustment means 6 adjusts a phase of at least one of the high-frequency signal to be input to the first excitation unit 3 and high-frequency signal to be input to the second excitation unit 4 in the range of change from 0 to 270 or more degrees, thereby being able to appropriately correct the input phase error of the high-frequency signals to be input to the first excitation unit 3 and the second excitation unit 4. Accordingly, it is possible to improve the axial ratio of an elliptically polarized wave that is generated, thereby being able to improve communication quality.

First Exemplary Embodiment

Figure 2:
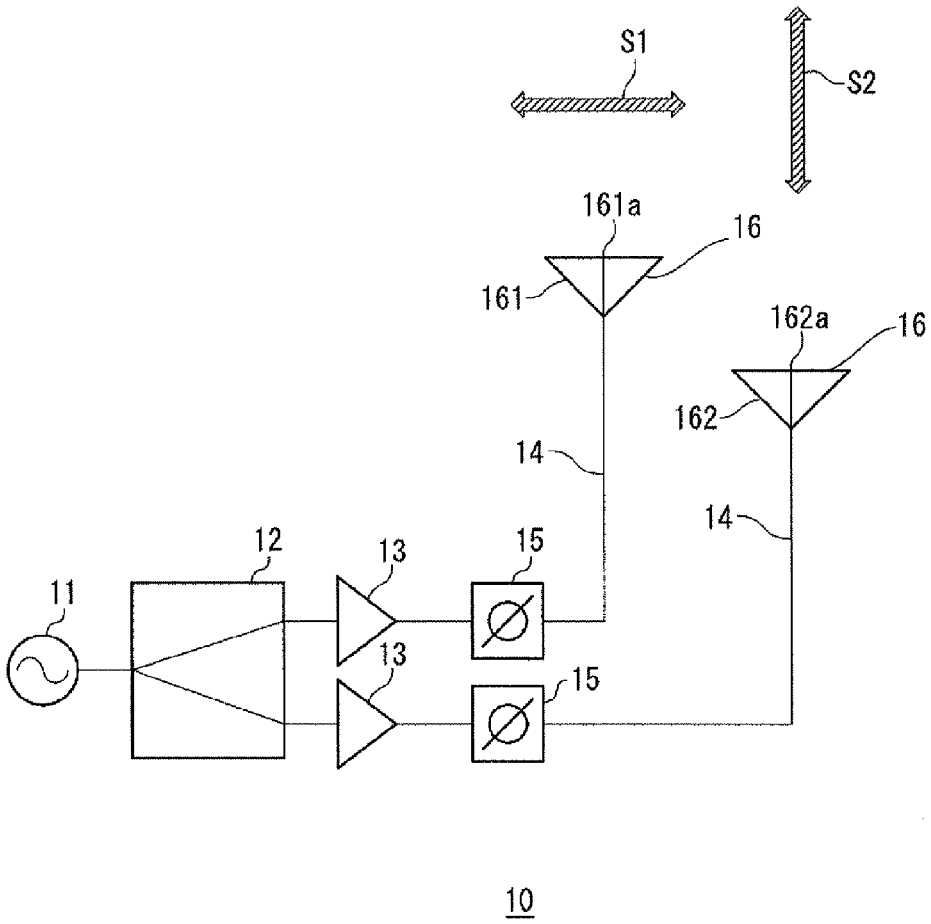
FIG. 2 is a block diagram showing a schematic system configuration of an antenna apparatus according to a first exemplary embodiment of the present invention.

FIG. 2 is a block diagram showing a schematic system configuration of an antenna apparatus according to a first exemplary embodiment of the present invention. An antenna apparatus 10 according to the first exemplary embodiment includes a high-frequency source 11, a branch circuit 12, a pair of power regulators 13, a pair of power supply lines 14, a pair of phase adjustment mechanisms 15, and an array antenna element 16.

Note that the antenna apparatus 10 is formed in hardware to mainly include a microcomputer including a CPU (Central Processing Unit) for performing control processing, operation processing and the like, a ROM (Read Only Memory) for storing a control program, an operation program and the like executed by the CPU, and a RAM (Random Access Memory) for storing processing data and the like, for example.

The high-frequency source 11 is one specific example of the high-frequency output means 2, and generates a high-frequency signal in the band of 60 GHz, for example. Further, the branch circuit 12 is connected to the high-frequency source 11, and the high-frequency source 11 outputs the high-frequency signal that is generated to the branch circuit 12.

The branch circuit 12 is one specific example of branch means, and divides the high-frequency signal output from the high-frequency source 11 into two signals. Further, the pair of power regulators 13 are connected to the branch circuit 12, and the branch circuit 12 outputs the high-frequency signals that are divided to the respective power regulators 13.

Each of the power regulators 13 is one specific example of power adjustment means. The power regulators 13 each adjust the power ratio of the high-frequency signal to be input to the array antenna element 16 to determine the polarization direction of a linearly polarized wave or an elliptically polarized wave emitted from the array antenna element 16. In the first exemplary embodiment, the power regulators 13 are not necessarily provided in order to improve the axial ratio of the polarized wave. The power regulators 13 are respectively connected to the array antenna element 16 via the pair of power supply lines 14. Further, the phase adjustment mechanisms 15 are provided in the respective power supply lines 14.

Each of the phase adjustment mechanisms 15 is one specific example of the phase adjustment means 6, and is able to continuously change the phase of the high-frequency signal to be input to the array antenna element 16 in a range from 0 to 360 degrees. Each of the phase adjustment mechanisms 15 is able to provide a phase difference to the high-frequency signal to be input to a first excitation unit 161*a* of a first antenna element 161 and the high-frequency signal to be input to a second excitation unit 162*a* of a second antenna element 162 of the array antenna element 16 as described below.

For example, when each of the phase adjustment mechanisms 15 provides the phase difference of 0 or 180 degrees to each of the high-frequency signals, the array antenna element 16 generates a linearly polarized wave according to the phase difference of the high-frequency signals. Further, when each of the phase adjustment mechanisms 15 provides the phase difference of 90 or 270 degrees to each of the high-frequency signals, the array antenna element 16 generates a circularly polarized wave according to the phase difference of the high-frequency signals. While the pair of phase adjustment mechanisms 15 are provided in the respective pair of power supply lines 14, such a configuration may be employed in which the phase adjustment mechanism 15 is provided only in one of the pair of power supply lines 14.

The array antenna element 16 is one specific example of the antenna means 5, and emits the linearly polarized wave or the elliptically polarized wave, for example, according to the high-frequency signal adjusted by each of the phase adjustment mechanisms 15. Further, the array antenna element 16 includes the first antenna element 161 including the first excitation unit 161*a* and the second antenna element 162 including the second excitation unit 162*a*. Further, the pair of power supply lines 14 are connected to the first excitation unit 161*a* and the second excitation unit 162*a*, respectively. The first excitation unit 161*a* and the second excitation unit 162*a* excite radiation electric fields that are orthogonal to each other according to the high-frequency signal supplied via each of the power supply lines 14.

The first excitation unit 161*a* of the first antenna element 161 is excited according to the adjusted high-frequency signal output from the phase adjustment mechanism 15, to emit a first linearly polarized wave S1. Further, the second excitation unit 162*a* of the second antenna element 162 is excited according to the adjusted high-frequency signal output from the phase adjustment mechanism 15, to emit a second linearly polarized wave S2 that is orthogonal to the first linearly polarized wave S1 at the same time with the first linearly polarized wave S1. Then, the linearly polarized waves S1 and S2 that are simultaneously emitted from the first excitation unit 161*a* and the second excitation unit 162*a* are synthesized to be the linearly polarized wave or the elliptically polarized wave. In summary, each of the phase adjustment mechanisms 15 adjusts the input phase of the high-frequency signal to be input to each of the first excitation unit 161*a* and the second excitation unit 162*a*, thereby being able to generate the linearly polarized wave and the right-hand and left-hand elliptically polarized waves.

Incidentally, when there is generated a manufacturing error in the length of each power supply line in the related antenna apparatus, for example, there is generated an error in the input phases of the high-frequency signals input to the array antenna element (hereinafter referred to as an input phase error), which may result in generation of an elliptically polarized wave instead of a linearly polarized wave.

In order to deal with this, in the antenna apparatus 10 according to the first exemplary embodiment, the pair of phase adjustment mechanisms 15 that are able to adjust the phases of the high-frequency signals input to the array antenna element 16 are arranged in the respective pair of power supply lines 14. Accordingly, even when there is generated a manufacturing error in the length of each power supply line 14 as described above, for example, it is possible to appropriately correct the input phase error of the high-frequency signals input to the first excitation unit 161*a* and the second excitation unit 162*a* of the array antenna element 16 by each of the phase adjustment mechanisms 15. Accordingly, it is possible to improve the axial ratio of the elliptically polarized wave that is generated and to improve the communication quality.

It is preferable that each of the phase adjustment mechanisms 15 adjusts the phase of at least one of the high-frequency signal input to the first excitation unit 161*a* and the high-frequency signal input to the second excitation unit 162*a* in the range of change from 0 to 270 or more degrees. The range of change from 0 to 270 or more degrees is the range obtained by adding the phase error amount predicted from the manufacturing error of the power supply lines 14 to the range from 0 to 270 degrees, for example. Accordingly, it is possible to improve the axial ratio of the elliptically polarized wave more efficiently, and to further improve the communication quality. For example, when the phase error amount predicted from the manufacturing error of the power supply lines 14 is 20 degrees, the range of change is the range from 0 to 290 degrees, in which the phase error amount of 20 degrees is added to the range from 0 to 270 degrees.

Second Exemplary Embodiment

Figure 3:
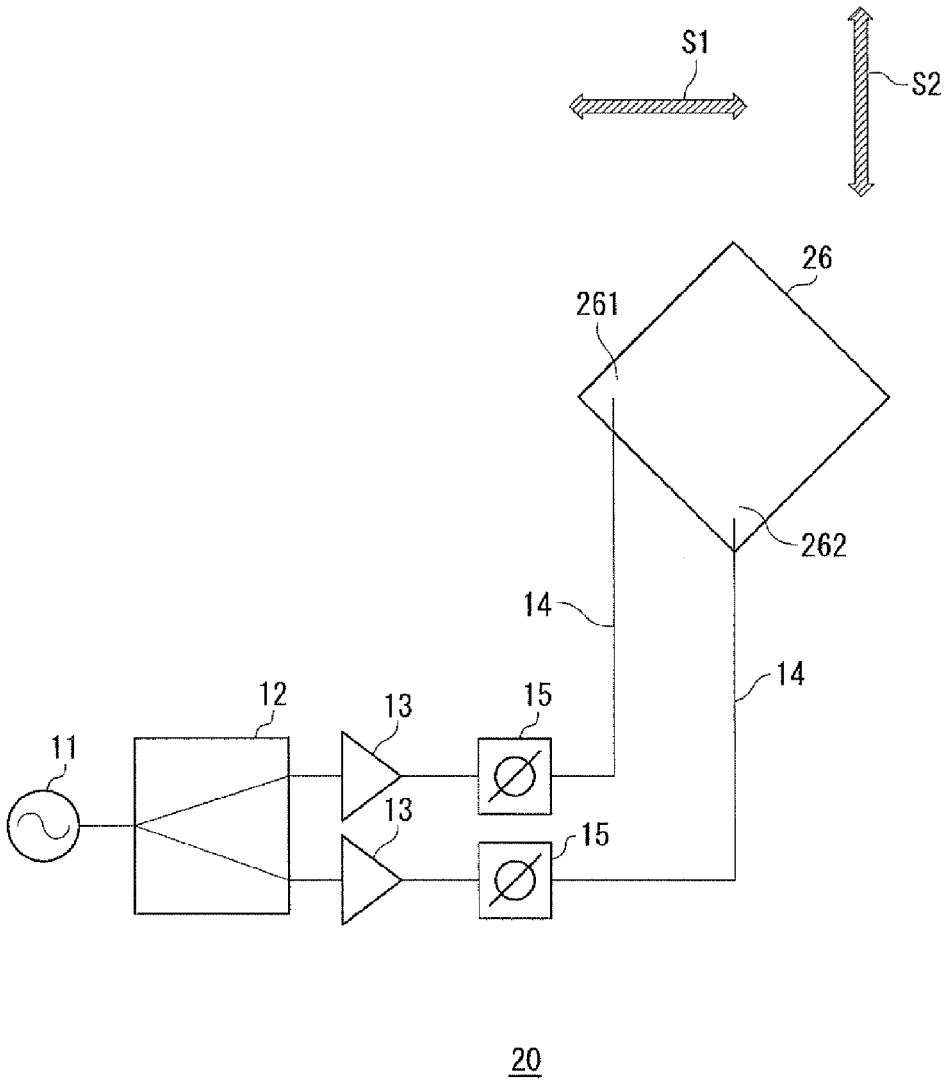
FIG. 3 is a block diagram showing a schematic system configuration of an antenna apparatus according to a second exemplary embodiment of the present invention.

FIG. 3 is a block diagram showing a schematic system configuration of an antenna apparatus according to a second exemplary embodiment of the present invention. The antenna apparatus 10 according to the first exemplary embodiment has a configuration of including the array antenna element 16 including the first antenna element 161 including the first excitation unit 161*a* and the second antenna element 162 including the second excitation unit 162*a*, whereas an antenna apparatus 20 according to the second exemplary embodiment includes a single patch antenna (antenna element) 26 including a first excitation unit 261 and a second excitation unit 262. In this way, it is possible to further simplify the configuration, which may lead to cost reduction.

The first excitation unit 261 of the patch antenna 26 is excited according to the adjusted high-frequency signal output from the phase adjustment mechanism 15, and emits the first linearly polarized wave S1. Further, the second excitation unit 262 of the patch antenna 26 is excited according to the adjusted high-frequency signal output from the phase adjustment mechanism 15, and emits the second linearly polarized wave S2 that is orthogonal to the first linearly polarized wave S1 at the same time with the first linearly polarized wave S1.

In the antenna apparatus 20 according to the second exemplary embodiment, other configurations are substantially the same to those of the antenna apparatus 10 according to the first exemplary embodiment. Thus, the same components are denoted by the same reference symbols, and detailed description will be omitted.

Third Exemplary Embodiment

Figure 4:
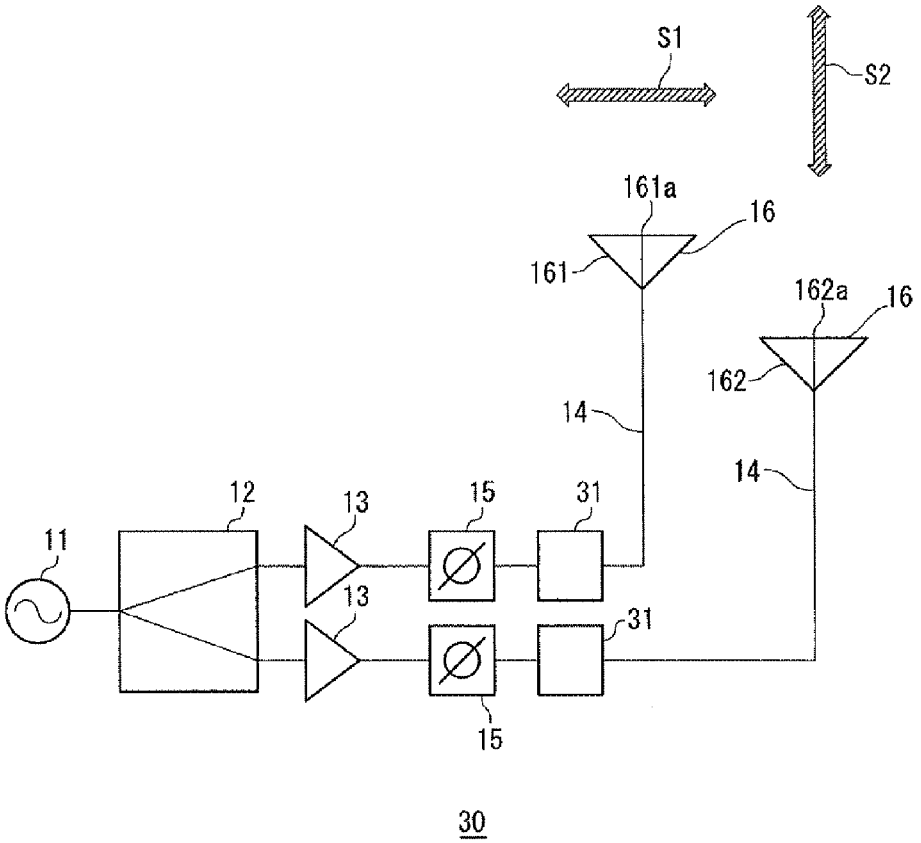
FIG. 4 is a block diagram showing a schematic system configuration of an antenna apparatus according to a third exemplary embodiment of the present invention.

FIG. 4 is a block diagram showing a schematic system configuration of an antenna apparatus according to a third exemplary embodiment of the present invention. An antenna apparatus 30 according to the third exemplary embodiment further includes a pair of phase shifters 31 for changing the phase of the high-frequency signal to be input to each of the first excitation unit 161*a* and the second excitation unit 162*a* of the array antenna element 16 by steps of about 90 degrees in addition to the configuration of the antenna apparatus 10 according to the first exemplary embodiment stated above. Further, each of the phase shifters 31 is one specific example of phase shifting means, and the phase shifters 31 are provided in the respective power supply lines 14.

Further, each of the phase adjustment mechanisms 15 is able to continuously change the phase of the high-frequency signal to be input to each of the first excitation unit 161*a* and the second excitation unit 162*a* of the array antenna element 16 in the range of change from 0 to 90 degrees. On the other hand, each of the phase shifters 31 is able to change the phase of the high-frequency signal to be input to each of the first excitation unit 161*a* and the second excitation unit 162*a* of the array antenna element 16 by steps of 90 degrees in the range of change from 0 to 270 degrees. Accordingly, it is possible to correct the input phase error of the high-frequency signals to be input to the first excitation unit 161*a* and the second excitation unit 162*a* of the array antenna element 16 with higher accuracy, and to further improve the axial ratio of the elliptically polarized wave that is generated.

In the antenna apparatus 30 according to the third exemplary embodiment, other configurations are substantially the same to those of the antenna apparatus 10 according to the first exemplary embodiment. Thus, the same components are denoted by the same reference symbols, and detailed description will be omitted.

Figure 5:
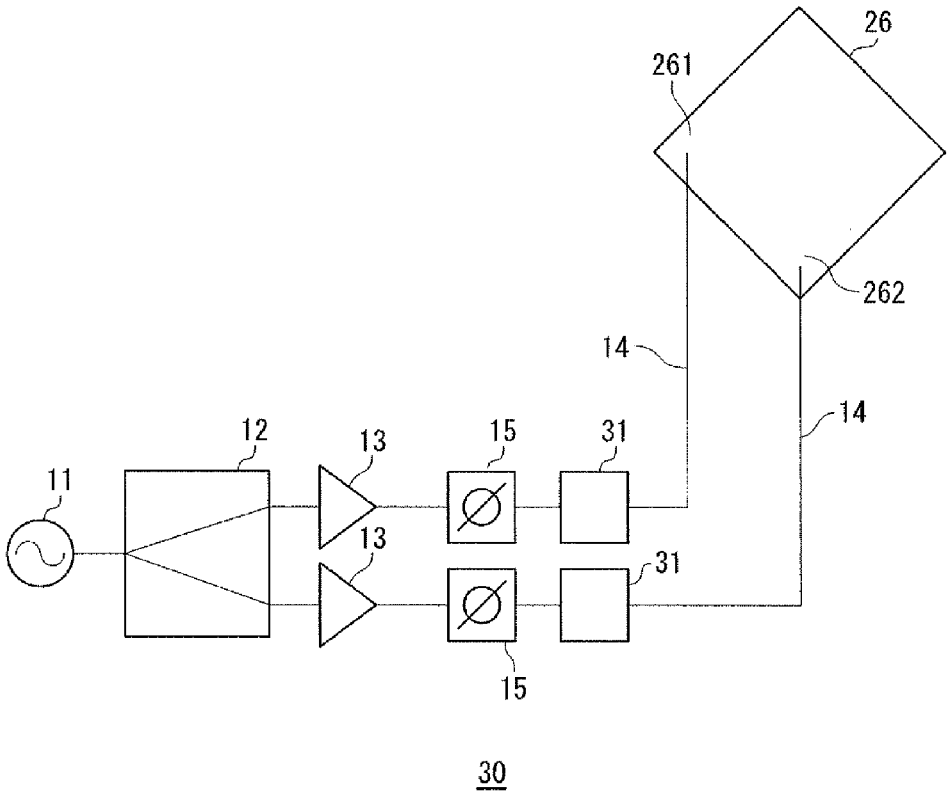
FIG. 5 is a block diagram showing a variant example of the antenna apparatus according to the third exemplary embodiment of the present invention.

The antenna apparatus 30 according to the third exemplary embodiment may have a configuration of including the single patch antenna 26 including the first excitation unit 261 and the second excitation unit 262 instead of including the array antenna element 16, as is similar to the antenna apparatus 20 according to the second exemplary embodiment (FIG. 5).

Furthermore, the present invention is not limited to the exemplary embodiments stated above, but may be changed as appropriate without departing from the spirit of the present invention.

For example, in the exemplary embodiments stated above, the antenna apparatuses 10, 20, and 30 each have a configuration of including the phase adjustment mechanisms 15 for changing the phases of the high-frequency signals. However, it is not limited to this example. The antenna apparatuses 10, 20, and 30 may each have a configuration of including quantization phase shifters for changing the phases of the high-frequency signals in a stepwise manner.

Figure 6:
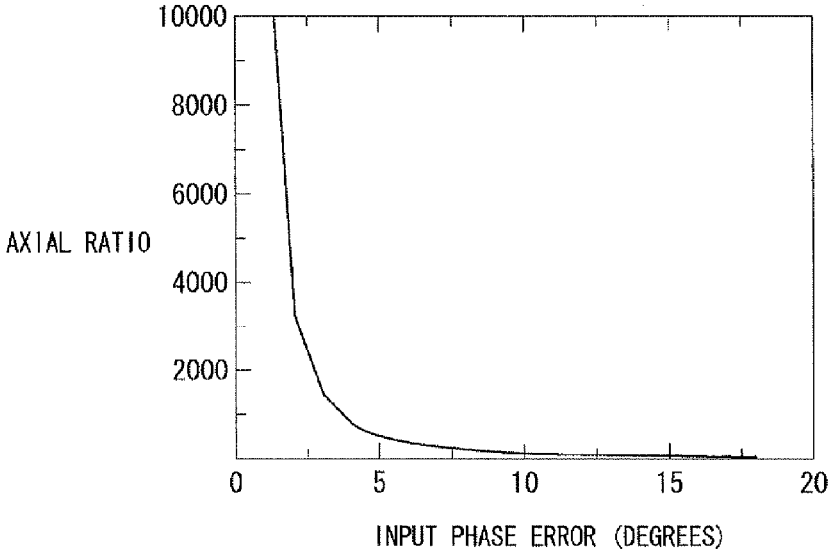
FIG. 6 is a diagram showing one example of a relation between an axial ratio and an input phase error.

FIG. 6 shows one example of a relation between the axial ratio and the input phase error when two ideal linearly polarized waves that are orthogonal to each other emitted from the first excitation unit 161*a* and the second excitation unit 162*a* of the array antenna element 16 are synthesized. As shown in FIG. 6, it will be understood that the axial ratio is greatly improved when the input phase error is smaller than 5 degrees. Meanwhile, it will be understood that the axial ratio is not greatly improved when the input phase error is 5 degrees or larger. In summary, in order to improve the axial ratio which is the effect of the present invention, it is required to maintain the input phase error within ±5 degrees. In this case, the quantization phase shifters preferably change the phases of the high-frequency signals by steps of 10 degrees or lower. Accordingly, as shown in FIG. 6, it is possible to greatly improve the axial ratio and to further improve the communication quality.

Figure 7:
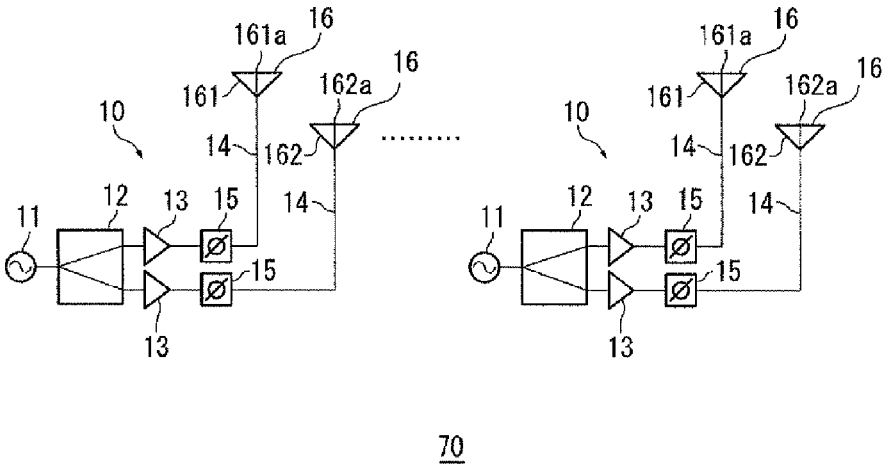
FIG. 7 is a block diagram showing a schematic system configuration of an antenna system.
Figure 8:
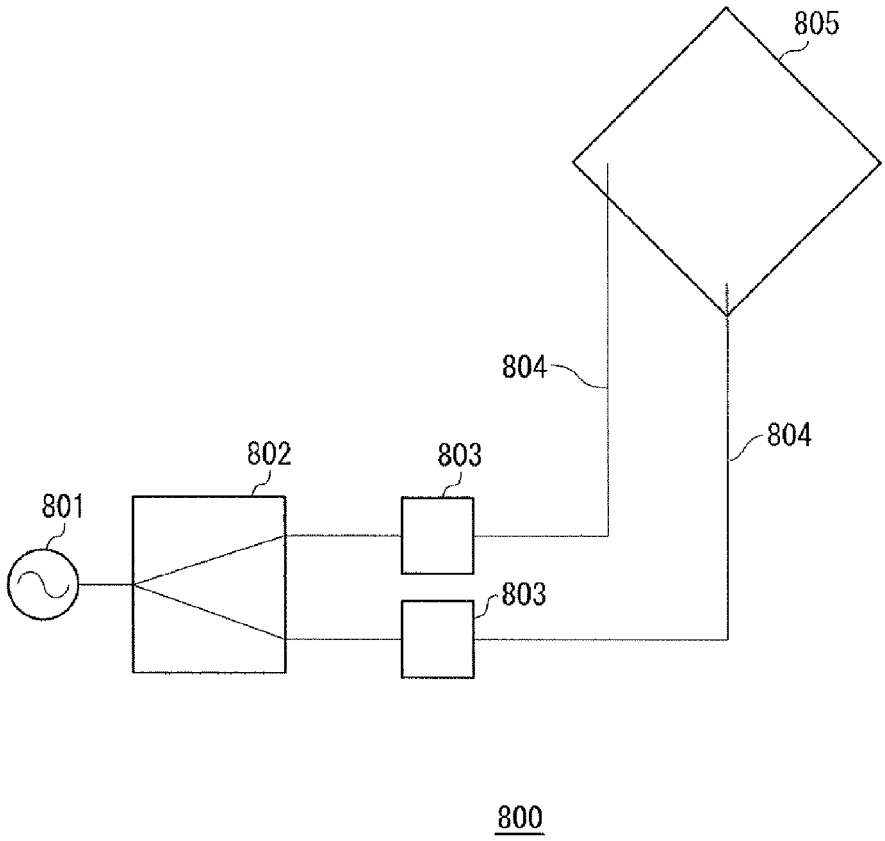
FIG. 8 is a block diagram showing a schematic system configuration of a related antenna apparatus.

Further, as shown in FIG. 7, it is possible to form an antenna system 70 by combining the antenna apparatuses 10 according to the first exemplary embodiment. In this configuration, it is possible to easily achieve the beam steering function while improving the axial ratio of the linearly polarized wave only by adjusting the phase adjustment mechanisms 15 of each antenna apparatus 10. When the beam steering is performed, it is only required to input the input phase that is required to determine the polarization direction, the phase correction value for improving the axial ratio, and the phase difference that is required for the beam steering to the phase adjustment mechanisms 15 of each of the antenna apparatuses 10. The antenna system may be formed by combining the antenna apparatuses 20 and 30 according to the second exemplary embodiment or the third exemplary embodiment.

A part or all of the aforementioned exemplary embodiments may be described as the following Supplementary Notes. However, it is not limited to the following description.

(Supplementary Note 1) An antenna apparatus including high-frequency output means for outputting a high-frequency signal; antenna means comprising a first excitation unit and a second excitation unit, the first excitation unit emitting a first linearly polarized wave according to the high-frequency signal output from the high-frequency output means, the second excitation unit emitting a second linearly polarized wave that is orthogonal to the first linearly polarized wave at the same time with the first linearly polarized wave according to the high-frequency signal output from the high-frequency output means; and phase adjustment means for adjusting a phase of at least one of the high-frequency signal to be input to the first excitation unit and the high-frequency signal to be input to the second excitation unit in a range of change from 0 to 270 or more degrees.

(Supplementary Note 2) The antenna apparatus according to (Supplementary Note 1), wherein the antenna means comprises a first antenna element including the first excitation unit and a second antenna element including the second excitation unit.

(Supplementary Note 3) The antenna apparatus according to (Supplementary Note 1), wherein the antenna means comprises an antenna element including the first excitation unit and the second excitation unit.

(Supplementary Note 4) The antenna apparatus according to any one of (Supplementary Note 1) to (Supplementary Note 3), wherein the high-frequency output means and the first excitation unit and the second excitation unit of the antenna means are connected via a pair of power supply lines, and the phase adjustment means is provided in at least one of the pair of power supply lines.

(Supplementary Note 5) The antenna apparatus according to any one of (Supplementary Note 1) to (Supplementary Note 4), wherein the range of change from 0 to 270 or more degrees is a range obtained by adding a phase error amount generated by a manufacturing error of the power supply lines to the range from 0 to 270 degrees.

(Supplementary Note 6) The antenna apparatus according to any one of (Supplementary Note 1) to (Supplementary Note 5), wherein the phase adjustment means continuously changes the phases of the high-frequency signal to be input to the first excitation unit and the high-frequency signal to be input to the second excitation unit.

(Supplementary Note 7) The antenna apparatus according to any one of (Supplementary Note 1) to (Supplementary Note 5), wherein the phase adjustment means changes the phases of the high-frequency signal to be input to the first excitation unit and the high-frequency signal to be input to the second excitation unit by steps of about 10 or smaller degrees.

(Supplementary Note 8) The antenna apparatus according to any one of (Supplementary Note 1) to (Supplementary Note 7), further comprising phase shifting means for changing the phase of the high-frequency signal to be input to the first excitation unit and the high-frequency signal to be input to the second excitation unit by steps of about 90 degrees.

(Supplementary Note 9) The antenna apparatus according to any one of (Supplementary Note 1) to (Supplementary Note 8), further comprising: branch means for dividing the high-frequency signal output from the high-frequency output means into two signals; and power adjustment means for adjusting a power ratio of the high-frequency signal divided by the branch means and is to be input to the first excitation unit and the second excitation unit of the antenna means, wherein the phase adjustment means adjusts the phase of the high-frequency signal adjusted by the power adjustment means.

(Supplementary Note 10) A method of adjusting an antenna apparatus comprising: high-frequency output means for outputting a high-frequency signal; and antenna means comprising a first excitation unit and a second excitation unit, the first excitation unit emitting a first linearly polarized wave according to the high-frequency signal output from the high-frequency output means, the second excitation unit emitting a second linearly polarized wave that is orthogonal to the first linearly polarized wave at the same time with the first linearly polarized wave according to the high-frequency signal output from the high-frequency output means, wherein a phase of at least one of the high-frequency signal to be input to the first excitation unit and the high-frequency signal to be input to the second excitation unit is adjusted in a range from 0 to about 270 or more degrees.

This application claims the benefit of priority, and incorporates herein by reference in its entirety, the following Japanese Patent Application No. 2010-117306 filed on May 21, 2010.

REFERENCE SIGNS LIST

1, 10, 20, 30 ANTENNA APPARATUS
11 HIGH-FREQUENCY SOURCE
12 BRANCH CIRCUIT
13 POWER REGULATOR
14 POWER SUPPLY LINE
15 PHASE ADJUSTMENT MECHANISM
16 ARRAY ANTENNA ELEMENT
161 FIRST ANTENNA ELEMENT
161A FIRST EXCITATION UNIT
162 SECOND ANTENNA ELEMENT
162A SECOND EXCITATION UNIT

The invention claimed is:

1. An antenna apparatus comprising:

high-frequency output means for outputting a high-frequency signal;

antenna means comprising a first excitation unit and a second excitation unit, the first excitation unit emitting a first linearly polarized wave according to the high-frequency signal output from the high-frequency output means, the second excitation unit emitting a second linearly polarized wave that is orthogonal to the first linearly polarized wave at the same time with the first linearly polarized wave according to the high-frequency signal output from the high-frequency output means; and phase adjustment means for adjusting a phase of at least one of the high-frequency signal to be input to the first excitation unit and the high-frequency signal to be input to the second excitation unit in a range of change from 0 to 270 or more degrees, wherein the high-frequency output means and the first excitation unit and the second excitation unit of the antenna means are connected via a pair of power supply lines, and wherein the phase adjustment means is provided in at least one of the pair of power supply lines, and wherein the range of change from 0 to 270 or more degrees is a range obtained by adding a phase error amount generated by a manufacturing error of the power supply lines to the range from 0 to 270 degrees.

2. The antenna apparatus according to claim 1, wherein the antenna means comprises a first antenna element including the first excitation unit and a second antenna element including the second excitation unit.

3. The antenna apparatus according to claim 1, wherein the antenna means comprises an antenna element including the first excitation unit and the second excitation unit.

4. The antenna apparatus according to claim 1 wherein the phase adjustment means continuously changes the phases of the high-frequency signal to be input to the first excitation unit and the high-frequency signal to be input to the second excitation unit.

5. The antenna apparatus according to claim 1, wherein the phase adjustment means changes the phases of the high-frequency signal to be input to the first excitation unit and the high-frequency signal to be input to the second excitation unit by steps of about 10 or smaller degrees.

6. The antenna apparatus according to claim 1, further comprising phase shifting means for changing the phase of the high-frequency signal to be input to the first excitation unit and the high-frequency signal to be input to the second excitation unit by steps of about 90 degrees.

7. The antenna apparatus according to claim 1, further comprising:

branch means for dividing the high-frequency signal output from the high-frequency output means into two signals; and power adjustment means for adjusting a power ratio of the high-frequency signal divided by the branch means and is to be input to the first excitation unit and the second excitation unit of the antenna means, wherein the phase adjustment means adjusts the phase of the high-frequency signal adjusted by the power adjustment means.

8. A method of adjusting an antenna apparatus comprising:

outputting, by a high frequency output means, a high-frequency signal;

emitting, by a first excitation unit of an antenna, a first linearly polarized wave according to the high-frequency signal;

emitting, by a second excitation unit of an antenna, a second linearly polarized wave that is orthogonal to the first linearly polarized wave at the same time with the first linearly polarized wave according to the high-frequency signal, wherein a phase of at least one of the high-frequency signal to be input to the first excitation unit and the high-frequency signal to be input to the second excitation unit is adjusted in a range from 0 to about 270 or more degrees, wherein the high-frequency output means and the first excitation unit and the second excitation unit of the antenna are connected via a pair of power supply lines, and wherein the range of change from 0 to 270 or more degrees is a range obtained by adding a phase error amount generated by a manufacturing error of the power supply lines to the range from 0 to 270 degrees.

* * * * *